US006510299B2

(12) United States Patent
Baughman

(10) Patent No.: US 6,510,299 B2
(45) Date of Patent: Jan. 21, 2003

(54) APPARATUS FOR SUPPLYING COOLING AIR TO A COOLER SECTION IN A FUSING DEVICE

(75) Inventor: Richard C. Baughman, Geneseo, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 79 days.

(21) Appl. No.: 09/753,774

(22) Filed: Jan. 3, 2001

(65) Prior Publication Data

US 2002/0085855 A1 Jul. 4, 2002

(51) Int. Cl.[7] ..... G03G 21/20
(52) U.S. Cl. ..... 399/92; 399/122; 138/119
(58) Field of Search ..... 399/92, 320, 122, 399/125; 219/216; 285/223; 403/50, 220; 137/779; 138/118, 119

(56) References Cited

U.S. PATENT DOCUMENTS 3,819,263 A * 6/1974 Draugelis et al. ..... 399/303
3,936,658 A * 2/1976 Traister et al. ..... 219/216
4,110,068 A * 8/1978 Brown et al. ..... 118/60
4,415,185 A * 11/1983 Vinciguerra et al. ..... 138/120
4,571,056 A * 2/1986 Tani et al. ..... 219/216
5,143,409 A * 9/1992 Lalikos ..... 285/114
5,320,331 A * 6/1994 Hellman, Sr. ..... 267/122
5,344,511 A * 9/1994 Graefe et al. ..... 138/125
5,803,506 A * 9/1998 Argersinger et al. ..... 285/14

* cited by examiner

*Primary Examiner*—Robert Beatty

(57) ABSTRACT

A copier/duplicator machine having a hose positioned to supply air to an upper cooler section in both its open and in its closed position, the hose being collapsible to its collapsed position when the cooler section is closed and stretchable to an open position of the cooler section with the hose having a spring ratio insufficient to cause the cooler section to close from its open position. In one embodiment, the hose has a stretch ratio of at least 2.4 and a spring ratio of less than 6 ounces per inch.

19 Claims, 4 Drawing Sheets

APPARATUS FOR SUPPLYING COOLING AIR TO A COOLER SECTION IN A FUSING DEVICE

FIELD OF THE INVENTION

This invention relates to copier/duplicator machines wherein an image is duplicated onto a medium such as paper and thereafter fixed to the paper to produce a copy. This invention more particularly relates to an improvement in methods and apparatus for supplying cooling air to a cooler section which functions to cool the paper after the image has been fixed on the paper.

BACKGROUND OF THE INVENTION

In the production of copies by electrophotographic processes a continuous loop of photoconductor film is commonly used. This photoconductor film is charged initially in a primary charging section and thereafter passed to an imaging section, a developing section, and an image transfer section where a toner image on the photoconductor film is transferred to a paper or other receiver medium (herein paper) to produce a copy of the toner image on the paper or other transfer. The paper is subsequently passed to a fuser section where the toner image on the paper is fixed to the paper by elevated pressure and temperature. The photoconductor film then passes through a neutralization section and thereafter past a brush cleaner, which removes, contaminates from the photoconductor film prior to passing the photoconductor film back through the primary charging section.

In the fuser section typically a pressure roller is in contact with a fuser roller to subject the paper bearing the toner image to elevated temperature and pressure to fix the toner image on the paper. As well known to those skilled in the art the fuser roller may be heated directly or indirectly. Further, either the fuser roller or pressure roller may be directly or indirectly driven to rotate the two rollers.

After passage through the fuser section, the paper is at an elevated temperature and it is undesirable that the paper be discharged from the copier/duplicator machine at the elevated temperature. Accordingly, a cooling section is provided both below and above the paper path as the paper is discharged from the fuser section. Cooling air is supplied to both a lower fuser section and an upper cooler section. In most machines the upper cooler section is rotatably or pivotally connected at one of its sides to the lower fuser section so that the cooler section can be opened and closed relative to the lower fuser section. The cooler section must be openable to provide access to the copier/duplicator machine components in the event of a paper jam and the opening and closing of the cooler section functions in some instances to impose a selected pressure on the pressure roller and the like. A variety of copier/duplicator machine components are included in both the cooler section and in the lower fuser section.

The cooler section requires a supply of air and since the cooler section is rotatably openable relative to the lower fuser section it has been necessary to provide an air passageway, which can accommodate this movement. In the past a first pipe section comprising rigid pipe member has been positioned on the lower fuser section (or the machine frame) in fluid communication with an air supply, and a second pipe section comprising a second rigid pipe member has been positioned on the cooler section so that when the cooler section is closed, the two pipes sections are more or less sealingly connected at a flange so that a continuous air passageway is provided from the air supply to the cooler section. This design, while it has been effective, is inefficient in that air is almost routinely lost to leakage at the junction of the two flanges. Further, in the event that machine wear or misalignment occurs the air passageway can be restricted at the junction of the two flanges. The structure includes fixed members and a plurality of mechanical parts, which are prone to malfunction. Accordingly, a continuing effort has been directed to the development of a better method and apparatus for passing air from the machine air supply to the cooler section.

SUMMARY OF THE INVENTION

According to the present invention a copier/duplicator machine is provided and comprises a lower fuser section and an upper cooler section rotatably connected to the lower fuser section at one of its sides so that the cooler section can be opened and closed relative to the lower fuser section and an air supply wherein a hose is positioned in fluid communication with the air supply and the cooler section, the hose being in a fully collapsed configuration when the cooler section is closed and having a stretch ratio sufficient to permit fully opening the cooler section and having a spring ratio sufficiently low that a spring load on the cooler section when the cooler section is open is insufficient to close the cooler section.

The invention further comprises an improvement in a copier/duplicator machine comprising a lower fuser section ad an upper cooler section rotatably connected to the lower fuser section at one of its sides so that the cooler section can be opened and closed relative to the lower fuser section and an air supply in fluid communication with the cooler section via an air passageway, the improvement comprising; forming the air passageway of a hose which is collapsed when the cooler section is closed and which has a stretch ratio sufficient to permit fully opening the cooler section and having a spring ratio sufficiently low that a spring load on the cooler section when the cooler section is open is insufficient to close the cooler section.

The invention further comprises a hose adapted to form an air passageway between an air supply ad an upper cooler section of a copier/duplicator machine having a lower fuser section with the cooler section being rotatably connected to the lower fuser section at one of its sides so that the cooler section can be opened and closed relative to the lower fuser section, the hose having a stretch factor of at least 2.4 and a spring ratio less than about 6 ounces per inch.

DESCRIPTION OF PREFERRED EMBODIMENTS

Figure 1:
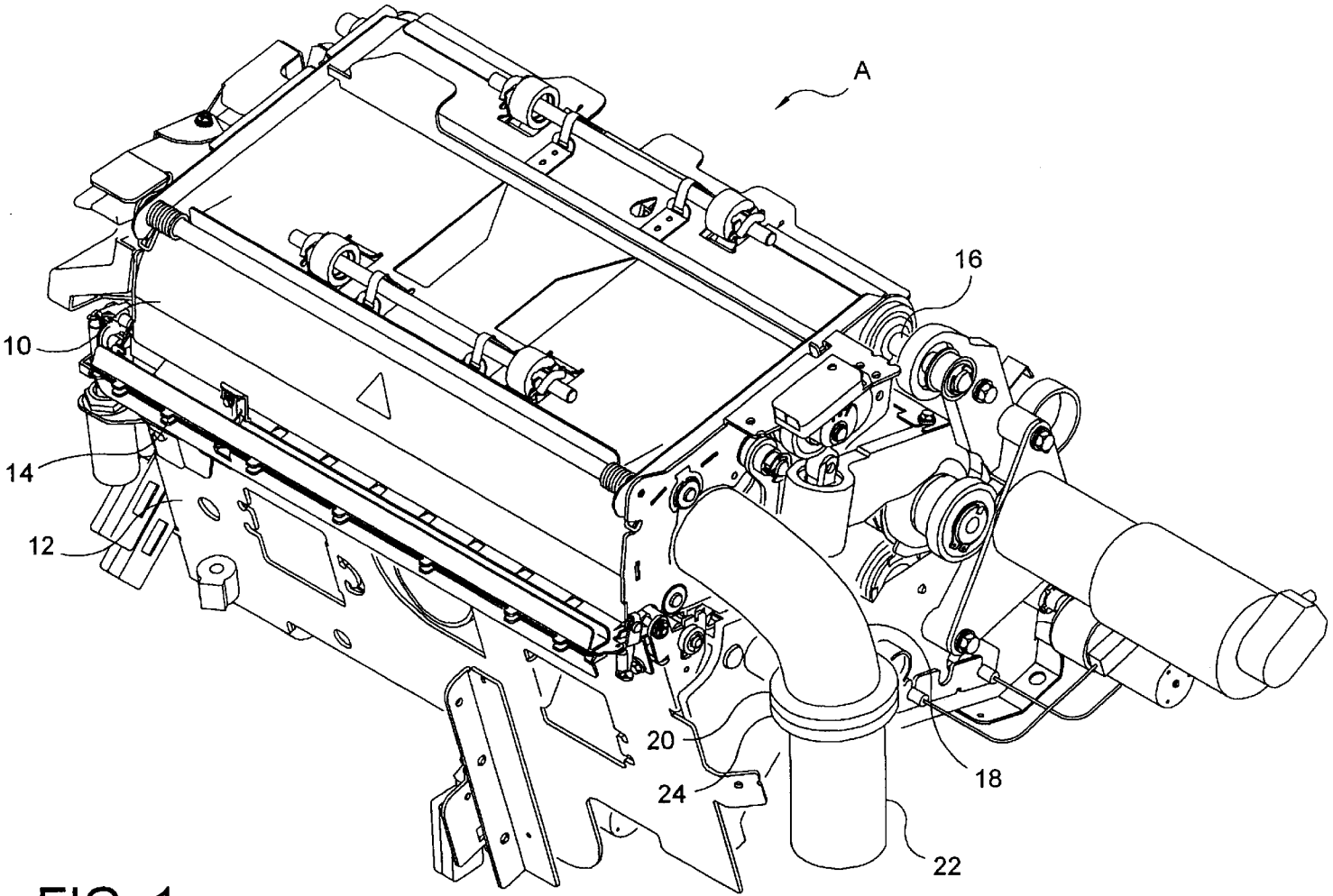
FIG. 1 (PRIOR ART)
FIG. 1 is a schematic diagram of a prior art air supply system to a cooler section.

In the discussion of the Figures the same numbers will be used through out to refer to the same or similar components. Further, it is noted that in the drawings many of the components of the copier/duplicator machine are shown the description of which is unnecessary to the description of the present invention. Such components have not been identified nor will they be discussed.

In FIG. 1 a prior art fuser section A is shown. Fuser section A comprises an upper cooler section 10 referred to herein as an upper cooler section or simply as a cooler section. Fuser section A also includes a lower fuser section 12 which typically includes a fuser roller, a pressure roller and associated components. The section also typically includes air cooling section component parts to cool the paper and provide a smooth flow of paper through the fuser section and out through a paper discharge 14. The cooler section 10 is connected at a pivotal connection 16 so that it is rotatably openable relative to lower fuser section 12. Both lower fuser section 12 and upper cooler section 10 require a cooling air supply to cool the paper prior to its discharge from the fuser section. The air has been supplied to cooler section 10 in the past by an arrangement such as shown in FIG. 1 where a first pipe 18 is positioned to pass cooling air into cooler section 10. First pipe 18 includes a first flange 20, which is configured to matingly engage a second flange 24 and a second pipe 22, which is in fluid communication with a machine air supply. When cooler section 10 is closed flanges 20 and 24 are in engagement and an air passageway is completed from the air supply (not shown) to cooler section 10.

Figure 2:
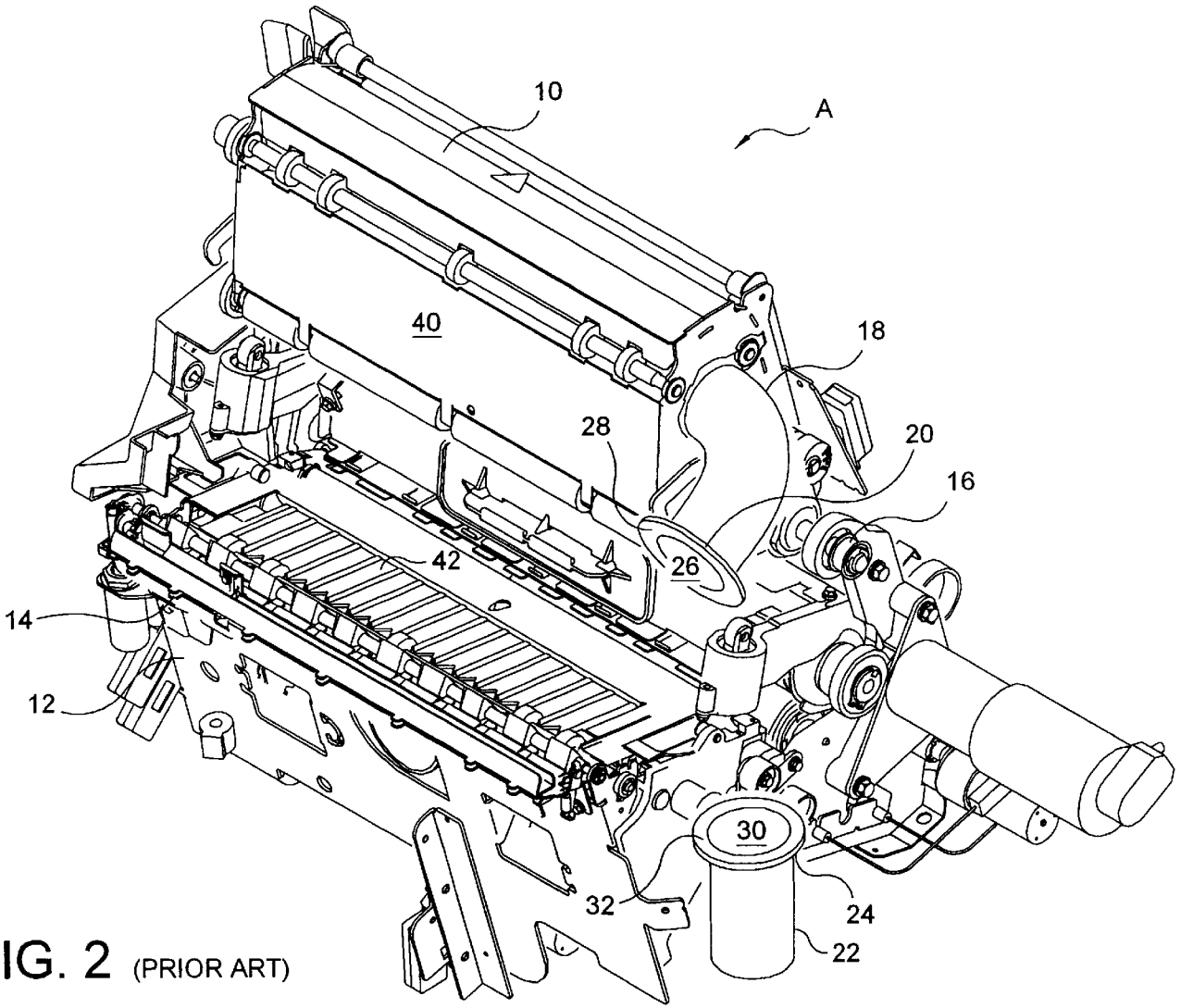
FIG. 2 (PRIOR ART)
FIG. 2 is a schematic diagram of the apparatus shown in FIG. 1 with the cooler section in an opened position.

In FIG. 2 the fuser section of FIG. 1 is shown with cooler section 10 being in an opened position. In this position flanges faces 28 and 32 are visible on first flange 20 and second flange 24 respectively. Similarly, an opening 26 in first pipe 18 and an opening 30 in second pipe 22 are visible. Sealing material of various types may be used on the flange faces to improve the air sealing ability of the flanges. It should be apparent however that in the event of any flange misalignment or other maladjustment of cooler section 10 relative to lower fuser section 12 flanges 20 and 24 may not engage perfectly. Even if the flanges are in complete engagement there may be air leakage between the flanges as a result of aging or contamination of any sealing material positioned on the flanges and the like. Further it will be noted that these are relatively fixed component parts and that each of the first and second pipe include a plurality of features such as flanges, sealing members and the like. Further, since these components are rigidly fixed to the machine they are vulnerable to being knocked out of position by impacts with either or both of the first or second pipes 18 and 22 and the like. As a result, the supply of air to cooler section 10 is only accomplished without leakage in ideal situations. Since it is predictable that ideal situations will not prevail in all instances an improved method for supplying air to cooler section 10 more economically and more efficiently has been sought.

Figure 3:
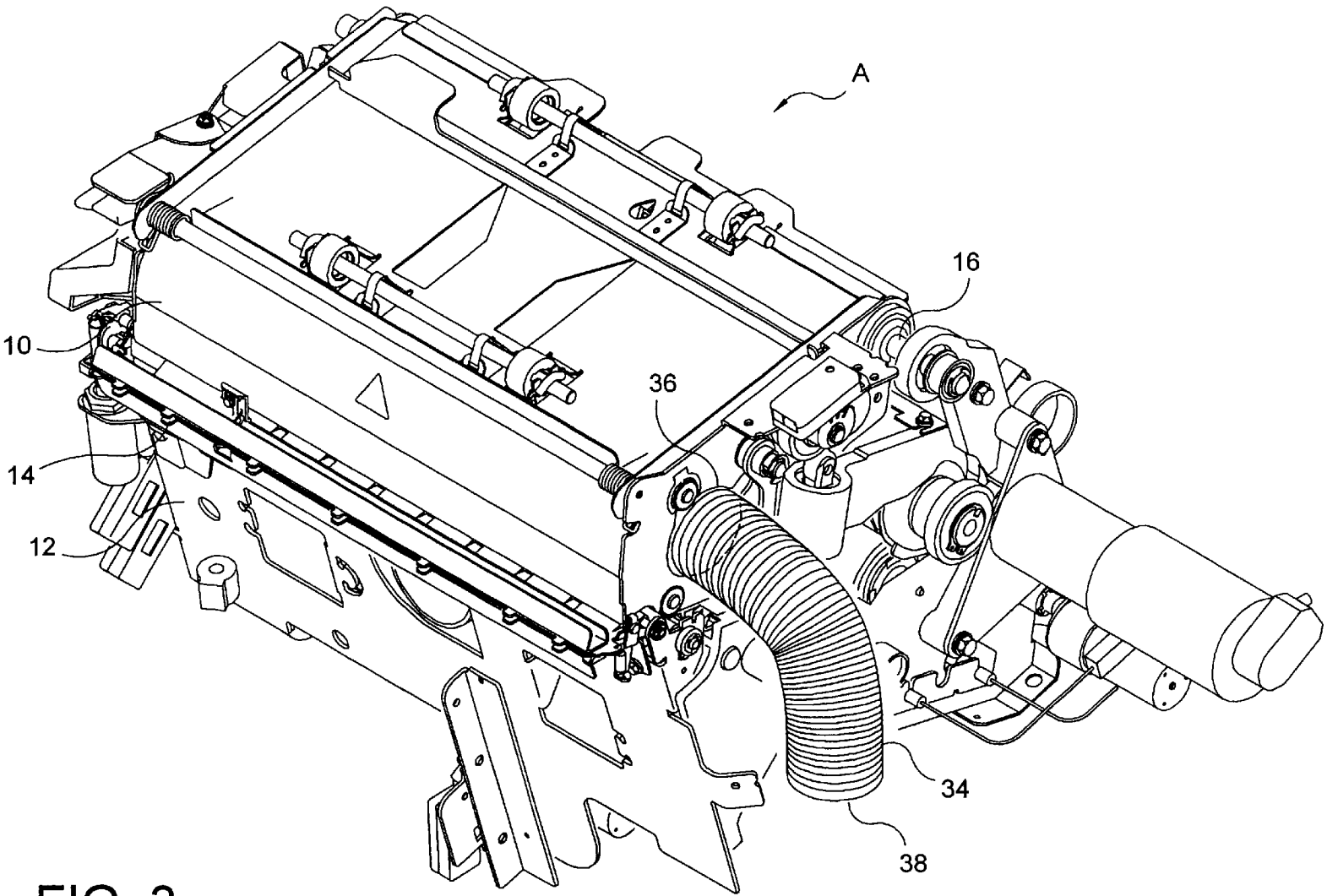
FIG. 3 is an embodiment of the present invention with the cooler section in a closed position; and, FIG. 4 is a schematic diagram of an embodiment of the present invention as shown in FIG. 3 with the cooler section opened.

According to the present invention air is supplied to cooler section 10 as shown in FIG. 3 via a hose 34. Hose 34 is connected to cooler section 10 at a connection 36 and to the air supply at a connection 38. The air is supplied through the hose without leakage. The hose is much more economical to install and maintain than the equipment shown in FIGS. 1 and 2. Previously the use of hoses has been avoided because the hoses tended to slump when cooler section 10 was closed and they tended to impose more spring force on cooler section 10 in its open position than could be tolerated. In other words, the spring force was sufficient to cause cooler section 10 to close if unattended. In FIG. 3 the hose of the present invention is shown in position with cooler section 10 closed.

Figure 4:
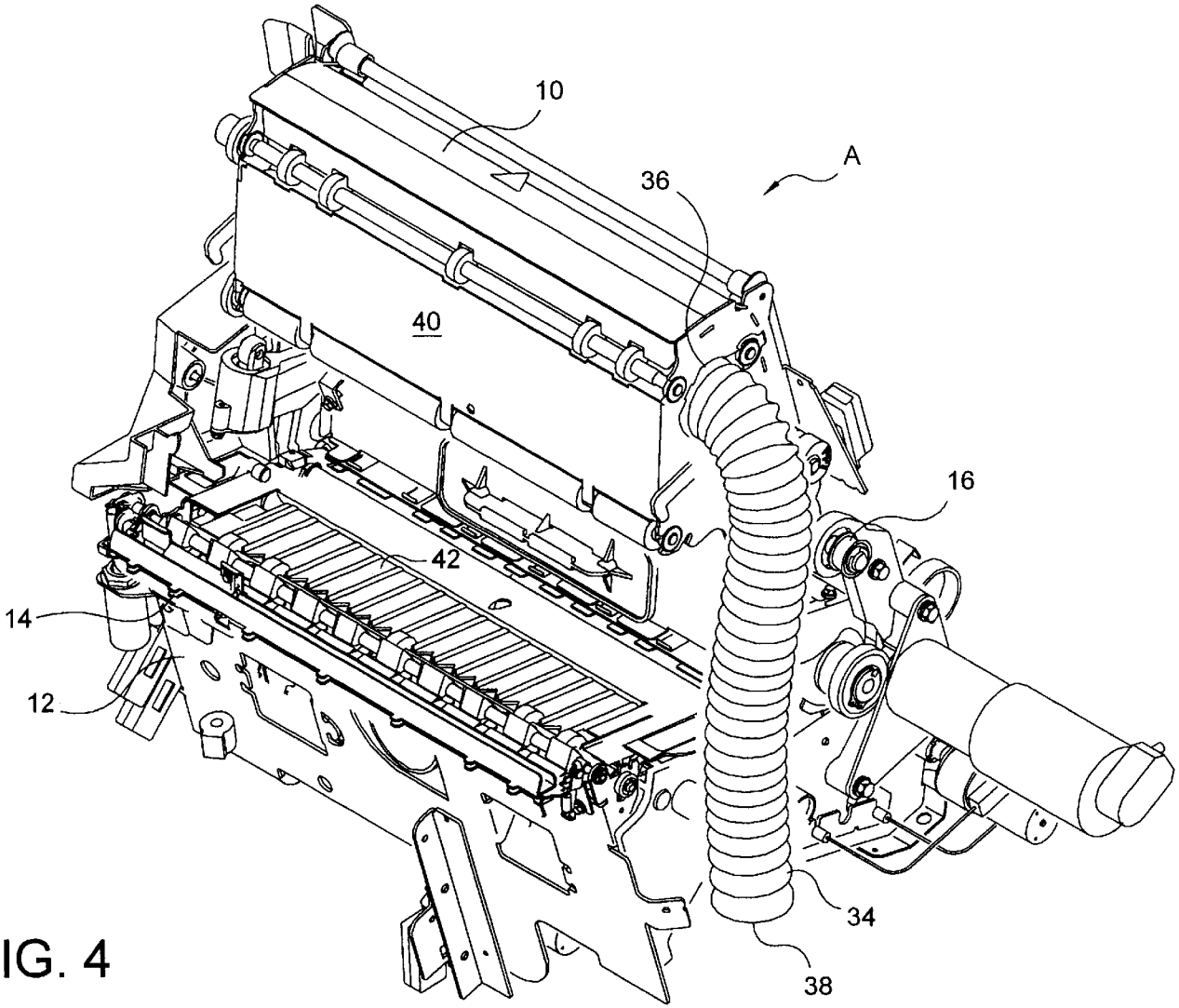

In FIG. 4 and FIG. 2 an air distribution sheet 40 typically used in cooler section 10 is shown. This sheet is typically a high temperature plastic sheet including an plurality of perforations which pass air into cooling contact with the paper as it passes from fuser section A. Further, an arrangement of openings 42 is shown in lower fuser section 14 which distribute air from lower fuser section 12 to cool the paper on its lower side as it is discharged from fuser section A. It has now been surprisingly found that a hose can be produced and used to supply air to cooler section 10 which will maintain its configuration in a fully collapsed position without slumping. This permits the positioning of the hose in a position where it is not readily snagged by passing equipment or engaged by machine repairmen, machine users and the like. The hose found useful has a stretch ratio (stretch ratio equals stretch length divided by collapsed length) of at least 2.4. Desirably the hose also has a spring ratio (force required to expand the hose for 1 inch) of less than about 6 ounces per inch. Preferably, the spring ratio is less than about 3 ounces per inch. Further, the hose is required to be produced of a material, which meets applicable safety and environmental requirements and particularly is suitably resistant to combustion.

It has been found that a suitable hose having the above properties is readily produced as a pleated polyvinyl chloride polymer hose. The hose is fabricated to the standards above and is suitably resistant to combustion. Such a hose has been fabricated and produced by Dayco Industrial Division, El Paso, Tex. of a polyvinyl chloride polymer identified as AD7503.

The present invention has required the identification of specific properties for the hose which permit it to expand as required while exerting a spring force insufficient to cause closing of the cooling section as a result of the spring force. The hose must collapse to its initial collapsed position when cooling section 10 is closed. Upon development of the required hose property specifications it was found that no hose was commercially available which met the required properties. Accordingly, a hose was specifically designed and fabricated to facilitate the passage of air into cooler section 10 while not interfering with the operation of fuser section A by the presence of a slumping or deformable hose while at the same time permitting the opening of cooler section 10 without a biasing force on cooler section 10 sufficient to cause it to close if left unattended. The development of a hose system for supplying air with a hose meeting the required detailed specifications has resulted in a significant improvement in the overall operation of fuser section A.

Having thus described the present invention by reference to its preferred embodiments it is pointed out that the embodiments described are illustrative rather than limiting in nature and that many variations and modifications are possible within the scope of the present invention.

What is claimed is:

1. A copier/duplicator machine comprising a lower fuser section and an upper cooler section rotatably connected to the lower fuser section at one of its sides so that the cooler section can be opened and closed relative to the lower fuser section and an air supply wherein a hose is positioned in fluid communication with the air supply and the cooler section, the hose being in a fully collapsed configuration when the cooler section is closed and having a stretch ratio sufficient to permit fully opening the cooler section and having a spring ratio sufficiently low that a spring load on the cooler section when the cooler section is open is insufficient to close the cooler section.

2. The machine of claim 1 wherein the hose has a spring ratio less than about 6 ounces per inch.

3. The machine of claim 1 wherein the hose has a spring ratio less than three ounces per inch.

4. The machine of claim 1 wherein the hose has a stretch ratio of at least about 2.4.

5. The machine of claim 1 wherein the hose is a pleated polyvinyl chloride polymer hose.

6. In a copier/duplicator machine comprising a lower fuser section and an upper cooler section rotatably connected to the lower fuser section at one of its sides so that the cooler section can be opened and closed relative to the lower fuser section and an air supply in fluid communication with the cooler section via an air passageway, the improvement comprising forming the air passageway of a hose which is collapsed when the cooler section is closed and which has a stretch ratio sufficient to permit fully opening the cooler section and having a spring ratio sufficiently low that a spring load on the cooler section when the cooler section is open is insufficient to close the cooler section.

7. The improvement of claim 6 wherein the hose is a pleated polyvinyl chloride hose.

8. The improvement of claim 7 wherein the hose has a spring ratio less than about 6 ounces per inch.

9. The improvement of claim 7 wherein the hose has a stretch ratio of at least 2.4.

10. The improvement of claim 7 wherein the hose has a spring ratio less than three ounces per inch.

11. The improvement of claim 6 wherein the hose has a spring ratio less than about 6 ounces per inch.

12. The improvement of claim 6 wherein the hose has a spring ratio less than 3 ounces per inch.

13. The improvement of claim 6 wherein the hose has a stretch ratio of at least 2.4.

14. A hose adapted to form an air passageway between an air supply and an upper cooler section of a copier/duplicator machine having a lower fuser section with the cooler section being rotatably connected to the lower fuser section at one of its sides so that the cooler section can be opened and closed relative to the lower fuser section, the hose having a stretch ratio of at least 2.4 and a spring ratio less than about 6 ounces per inch.

15. The hose of claim 14 wherein the spring ratio is less than about 3 ounces per inch.

16. The hose of claim 14 wherein the hose is a pleated polyvinyl chloride polymer hose.

17. The hose of claim 16 wherein the hose has a spring ratio less than about 3 ounces per inch.

18. The hose of claim 17 wherein the hose returns to its initial collapsed position when the cooler section is closed.

19. The hose of claim 17 wherein a spring force exerted by the hose when the cooler section is open is insufficient to close the cooler section.

* * * * *